US008955269B2

(12) United States Patent
Rillie

(10) Patent No.: US 8,955,269 B2
(45) **Date of Patent: *Feb. 17, 2015**

(54) SKYLIGHT TUBE WITH REFLECTIVE FILM AND SURFACE IRREGULARITIES

(75) Inventor: David Windsor Rillie, Cardiff, CA (US)

(73) Assignee: Solatube International, Inc., Vista, CA (US)

( * ) Notice: Subject to any disclaimer, the term of this patent is extended or adjusted under 35 U.S.C. 154(b) by 1254 days.

This patent is subject to a terminal disclaimer.

(21) Appl. No.: 12/349,084

(22) Filed: Jan. 6, 2009

(65) Prior Publication Data

US 2009/0113824 A1 May 7, 2009

Related U.S. Application Data

(63) Continuation of application No. 11/406,949, filed on Apr. 18, 2006, now Pat. No. 7,621,081, which is a continuation of application No. 09/823,474, filed on Mar. 30, 2001, now Pat. No. 7,146,768.

(51) Int. Cl.

| | |
|---|---|
| ***E04B 7/18*** | (2006.01) |
| ***E04D 13/03*** | (2006.01) |
| ***F21S 11/00*** | (2006.01) |
| *F21V 7/22* | (2006.01) |

(52) U.S. Cl.

CPC ..... *E04D 13/033* (2013.01); *F21S 11/00* (2013.01); *E04D 2013/0345* (2013.01); *F21V 7/22* (2013.01)

USPC ..... 52/200; 52/28; 52/173.3

(58) Field of Classification Search

USPC ..... 52/199, 200, 22, 17, 28, 29, 173.3

See application file for complete search history.

(56) References Cited

U.S. PATENT DOCUMENTS

| | | | | | |
|---|---|---|---|---|---|
| 4,339,900 | A * | 7/1982 | Freeman | 52/200 |
| 4,505,143 | A * | 3/1985 | Knudson | 72/187 |
| 5,502,935 | A * | 4/1996 | Demmer | 52/200 |
| 5,546,712 | A * | 8/1996 | Bixby | 52/200 |
| 5,551,042 | A * | 8/1996 | Lea et al. | 359/742 |
| 5,648,873 | A * | 7/1997 | Jaster et al. | 359/591 |
| 5,655,339 | A * | 8/1997 | DeBlock et al. | 52/200 |
| 5,878,539 | A * | 3/1999 | Grubb | 52/200 |
| 7,146,768 | B2 * | 12/2006 | Rillie | 52/200 |
| 2006/0191214 | A1 * | 8/2006 | Rillie | 52/200 |

* cited by examiner

*Primary Examiner* — Chi Q Nguyen

(74) *Attorney, Agent, or Firm* — John L. Rogitz

(57) ABSTRACT

A skylight shaft is coated with a highly reflective film to maximize the amount of light transmitted from the top of the skylight to a room below the skylight. Surface irregularities are formed in the shaft or adhesive that holds the film onto the shaft to diffuse the light and thereby prevent the formation of focal "hot spots" in the room below.

8 Claims, 5 Drawing Sheets

SKYLIGHT TUBE WITH REFLECTIVE FILM AND SURFACE IRREGULARITIES

This is a continuation of U.S. patent application Ser. No. 11/406,949, filed Apr. 18, 2006 now U.S. Pat. No. 7,621,081, which is a continuation of U.S. patent application Ser. No. 09/823,474, filed Mar. 30, 2001, now U.S. Pat. No. 7,146,768.

FIELD OF THE INVENTION

The present invention relates generally to skylights.

BACKGROUND

In U.S. Pat. Nos. 5,896,713 and 6,035,593, both of which are owned by the same assignee as is the present invention and both of which are incorporated herein by reference, tubular skylights are disclosed. Both of the skylights can use the skylight dome disclosed in U.S. Pat. No. 5,896,712 also owned by the same assignee as is the present invention and also incorporated herein by reference. These inventions represent advances over the prior art and one or more of them has found commercial success.

Briefly, a tubular skylight such as those mentioned above includes a tube assembly mounted between the roof and ceiling of a building. The top end of the tube assembly is covered by a roof-mounted dome or cover, such as the one disclosed in the above-mentioned '712 patent, while the bottom end of the tube assembly is covered by a ceiling-mounted diffuser plate. With this combination, natural light external to the building is directed through the tube assembly into the interior of the building to illuminate the interior.

The present invention has recognized that to optimize the light transmission into the building, the internal cylindrical surface of the tube assembly should be highly reflective. As understood by the present invention, one way to render a skylight tube assembly internally reflective is to laminate a reflective film onto the inside of the tube assembly or polish the inside of the assembly. With such a surface, the amount of light entering the dome that reflects off the tube walls as it propagates to the diffuser plate is maximized.

As understood herein, as the light is reflected through the tube assembly, focal points can form in the downwardly reflected light exiting the tube assembly. As further recognized by the present invention, the reflected light can become so intensely focused that it can damage the diffuser. Moreover, the diffuser is, at certain times, unable to diffuse all of the focal points in the reflected light exiting the tube assembly. These un-diffused focal points result in "hot spots" in the room sought to be lighted, i.e., bright spots, that appear on the walls, floor, etc. of the room in which the tubular skylight is installed. The present invention recognizes, however, that the light can be diffused within the tube assembly prior to reaching the diffuser so that the focal points are reduced.

SUMMARY OF THE INVENTION

A skylight assembly includes a skylight shaft having a layer of reflective film on the inside of the shaft. A layer of adhesive holds the film to the shaft. The skylight assembly further includes a surface irregularity formed in the adhesive, the reflective film, or the shaft.

In a preferred embodiment, a skylight dome covers the top end of the shaft. Moreover, a diffuser plate covers the bottom end of the shaft. The film can include plural layers and can have a specular reflectance of 50% or more. Most preferably, the film is greater than ninety-nine percent (99%) reflective.

The surface irregularity can be formed in the adhesive as the adhesive is deposited on the inside of the shaft, or it can be patterned into the film or substrate.

Preferably, the skylight assembly includes plural surface irregularities that establish a pattern, although the irregularities can be randomly distributed if desired. In a preferred embodiment, each surface irregularity includes an upper face and a lower face. The upper face establishes a first angle with respect to a long axis of the shaft. The lower face establishes a second angle with respect to the long axis of the shaft, and the first angle is more acute than the second angle.

In another aspect of the present invention, a skylight assembly includes a skylight shaft having a layer of reflective film on the inside of the shaft. A layer of adhesive holds the film to the shaft. Means for diffusing light as it is reflected through the length of the shaft are also provided.

In yet another aspect of the present invention, a method for making a skylight shaft includes providing a flat substrate, and forming surface irregularities in the substrate. Then, the flat substrate is rendered reflective. In this aspect, a shaft is formed out of the substrate.

In still another aspect of the present invention, a method for making a skylight shaft includes providing a flat substrate, forming surface irregularities in the substrate, and applying adhesive to the substrate. A reflective film is applied to the adhesive. A shaft is formed out of the substrate.

In another aspect of the present invention, a method for making a skylight shaft includes providing a flat substrate. Adhesive is applied to the substrate. In this aspect, surface irregularities are formed in the adhesive. A reflective film is applied to the adhesive. Then, a shaft is formed out of the substrate.

In still another aspect of the present invention, a skylight assembly includes a skylight shaft. This aspect further includes means for reflecting light through the shaft. Also, the skylight assembly includes means for diffusing light as it is reflected through the shaft.

In yet another aspect of the present invention, a skylight assembly includes a shaft. Also, the skylight assembly includes a reflective film having an otherwise smooth inner cylindrical surface except for at least one light diffusing anomaly.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
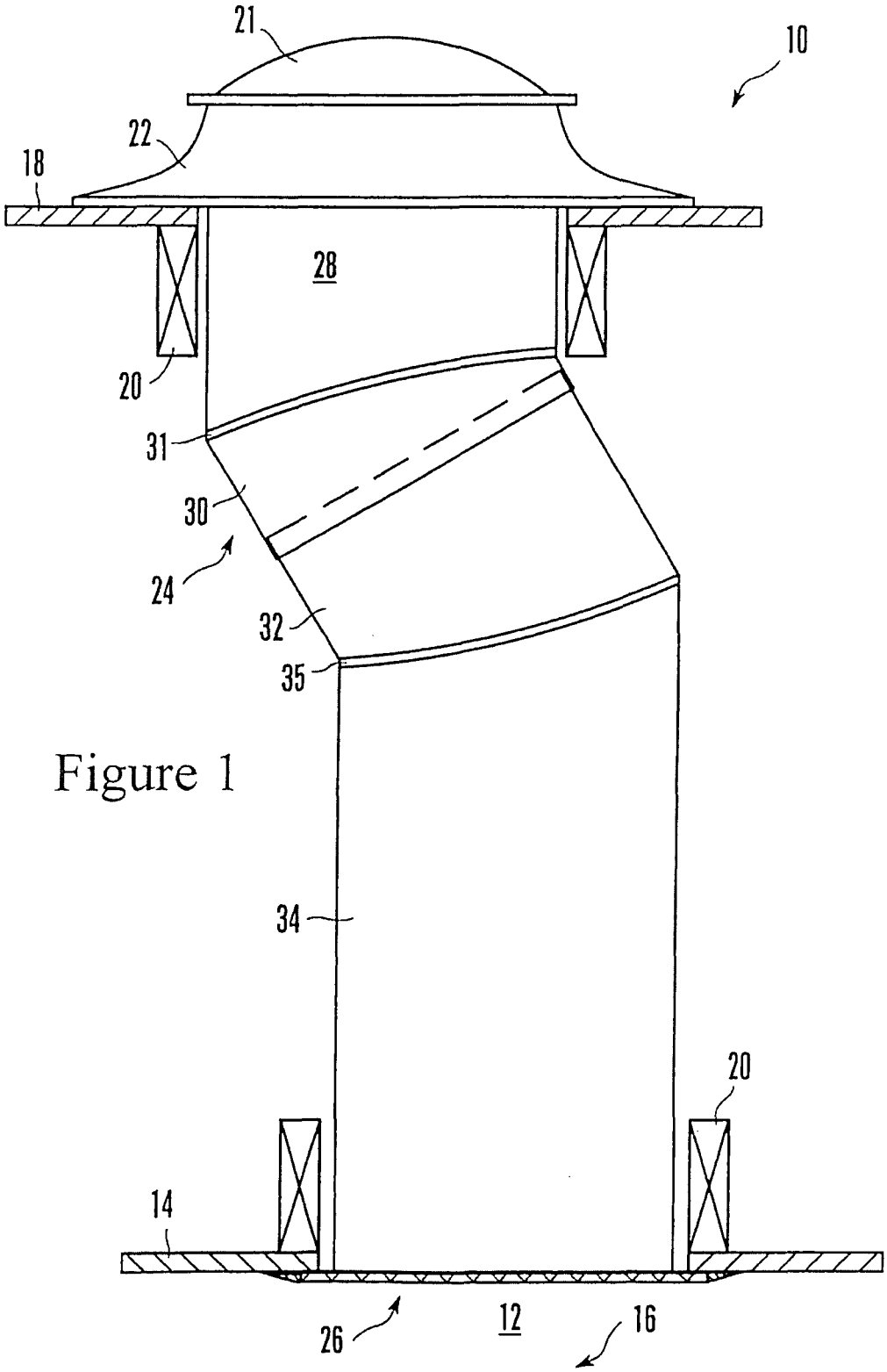
FIG. 1 is a side view in partial cross-section of the tubular skylight of the present invention.

Referring initially to FIG. 1, a tubular skylight made in accordance with the present invention is shown, generally designated 10, for lighting, with natural sunlight, an interior room 12 having a ceiling dry wall 14 in a building, generally designated FIG. 1 shows that the building 16 has a roof 18 and one or more joists 20 that support the roof 18 and ceiling dry wall 14.

As shown in FIG. 1, the skylight 10 includes a rigid hard plastic or glass roof-mounted cover 21. The cover 21 is optically transmissive and preferably is transparent. In one embodiment, the cover 21 can be the cover disclosed in the above-mentioned '712 patent. Or, the cover 21 can be other suitable covers, such as the covers marketed under the trade name "Solatube" by the present assignee.

The cover 21 is mounted to the roof 18 by means of a ring-like metal flashing 22 that is attached to the roof 18 by means well-known in the art. The metal flashing 22 can be angled as appropriate for the cant of the roof 18 to engage and hold the cover 21 in the generally vertically upright orientation shown.

As further shown in FIG. 1, an internally reflective hollow metal shaft assembly, generally designated 24, is connected to the flashing 22. The cross-section of the assembly 24 can be cylindrical, rectangular, triangular, etc. Accordingly, while the word "tube" is used from time to time herein, it is to be understood that the principles of the present invention are not to be limited to a tube per se.

The shaft assembly 24 extends to the ceiling 14 of the interior room 12. Per the present invention, the shaft assembly 24 directs light that enters the shaft assembly 24 downwardly to a light diffuser assembly, generally designated 26, that is disposed in the room 12 and that is mounted to the ceiling 14 or to a joist 20 as described in the above-mentioned '593 patent.

The shaft assembly 24 can be made of a metal such as an alloy of aluminum or steel, or the shaft assembly 24 can be made of plastic or other appropriate material. The interior of the shaft assembly 24 is rendered reflective by means of, e.g., electroplating, anodizing, metalized plastic film coating, or other suitable means. In one preferred embodiment, the shaft assembly 24 is rendered internally reflective by laminating the inside surface of the shaft assembly with a multi-ply polymeric film made by Minnesota Mining and Manufacturing (3M). A single ply of such film is transparent, but when hundreds of layers are positioned flush together and then thermally laminated to the interior surface of the shaft assembly 24, the combination is specularly reflective, preferably, over fifty percent (50%) specular reflective. By fifty percent (50%) specular reflective, it is meant that fifty percent (50%) of an incident beam is reflected back off the film for each reflection.

In one preferred embodiment, the shaft assembly 24 is established by a single shaft. However, as shown in FIG. 1, if desired, the shaft assembly 24 can include multiple segments, each one of which is internally reflective in accordance with present principles. Specifically, the shaft assembly 24 can include an upper shaft 28 that is engaged with the flashing 22 and that is covered by the cover 21. Also, the shaft assembly 24 can include an upper intermediate shaft 30 that is contiguous to the upper shaft 28 and that can be angled relative thereto at an elbow 31 if desired. Moreover, the shaft assembly 24 can include a lower intermediate shaft 32 that is slidably engaged with the upper intermediate shaft 30 for absorbing thermal stresses in the shaft assembly 24. And, a lower shaft 34 can be contiguous to the lower intermediate shaft 32 and join the lower intermediate shaft 32 at an elbow 35, with the bottom of the lower shaft 34 being covered by the diffuser assembly 26. The elbow 35 is angled as appropriate for the building 16 such that the shaft assembly 24 connects the roof-mounted cover 21 to the ceiling-mounted diffuser assembly 26. It is to be understood that where appropriate, certain joints between shafts can be mechanically fastened and covered with tape in accordance with principles known in the art.

Figure 2:
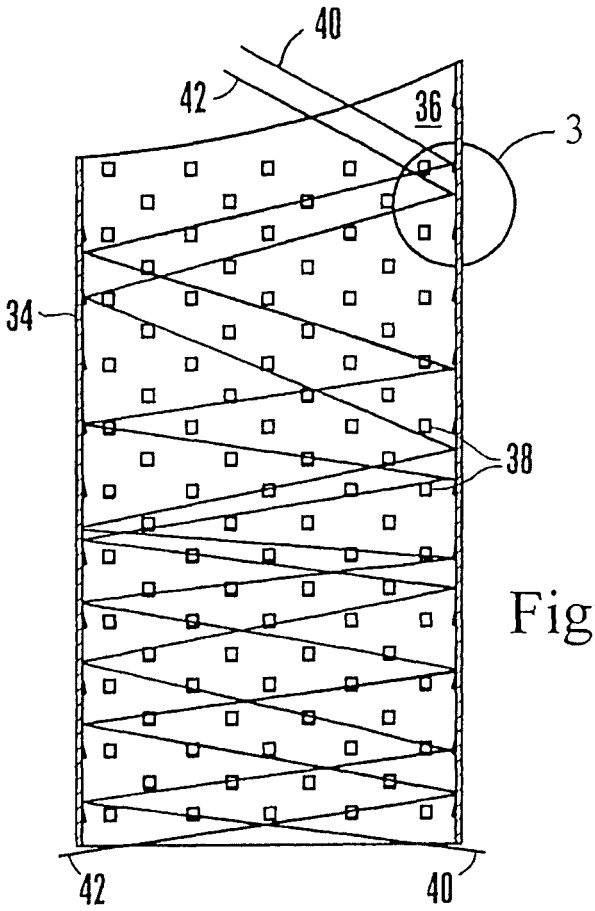
FIG. 2 is a cross-section view of a shaft, showing plural surface irregularities formed on the interior surface of the shaft.

As shown in FIG. 2 and disclosed in further detail below, each segment of the shaft assembly 24 (or the sole segment of a single-shaft assembly 24) is internally coated and configured as follows. Taking the lower shaft 34 as illustration, to provide a means by which light reflected through the shaft is diffused before reaching the diffuser assembly 26, plural surface irregularities 38 are formed on the interior surface 36 of the lower shaft 34. When a first ray of light, represented by line 40, is reflected by a surface irregularity 38, it is reflected at an angle with the interior surface 36 that is different from the reflection angle of a second ray of light, represented by line 42, that is reflected by a different portion of the interior surface 36. As shown, this continues as the light 40, 42 is reflected through the length of the shaft 34. Each time, the first ray of light 40 is reflected by a surface irregularity 38 or a smooth portion of the interior surface 36 at an angle different from the second ray of light 42. Thus, as sunlight, including the first ray 40 and second ray 42, is reflected through the shaft 34, it is diffused by the surface irregularities 38, and the likelihood of any focal points forming in the reflected light is eliminated. It is to be appreciated that the surface irregularities 38 can be formed at random or in a discernable pattern, as shown.

Figure 3A:
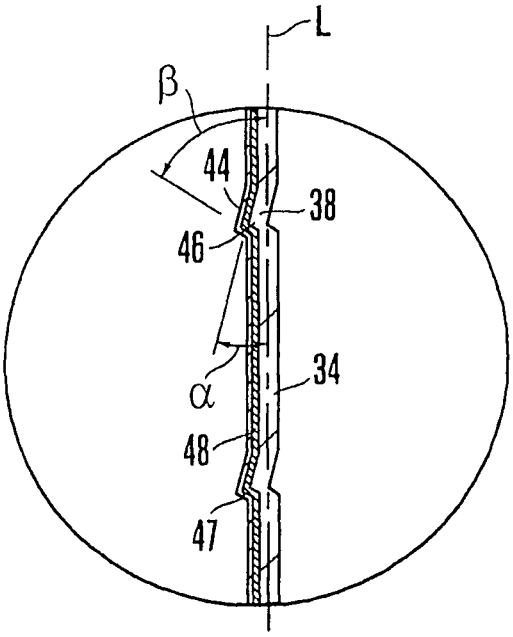
FIG. 3*a* is a detail view of one type of surface irregularity, shown by circle 3 in FIG. 2.

Referring to FIG. 3*a*, details concerning the configuration of a non-limiting example of a surface irregularity 38 is shown. FIG. 3 shows that a surface irregularity 38 can include an upper-oriented surface 44 and a lower-oriented surface 46. As shown, the upper surface 44 is formed at an angle $\alpha$ with respect to the longitudinal axis L. The angle $\alpha$ is such that it will alter the path of a ray of light striking it without causing the light to be reflected back up the shaft toward the skylight dome 21, e.g., $\alpha$<ninety degrees (90°). It is to be understood that the angle $\alpha$ can be altered if the shaft 34 is angled with respect to vertical in order to prevent light from being reflected up the shaft 34. The angle $\beta$ is chosen so that it is less acute than the angle $\alpha$, or otherwise established to ensure that the length of the lower-oriented surface 46 is less than the length of the upper-oriented surface 44, to prevent downward-propagating light from being reflected back up the shaft 34 toward the dome 21. It is to be appreciated that the surface irregularities 38 can be nearly any shape and size, as long as they alter the reflection angle of light traveling through the shaft 34, but do not reflect light back up the shaft 34. It is also to be appreciated that each of the shafts 28, 30, 32, 34 which can make up a multi-segment shaft assembly 24 can be formed with the surface irregularities 38 so as to diffuse the light along the entire length of the shaft assembly 24.

Figure 3B:
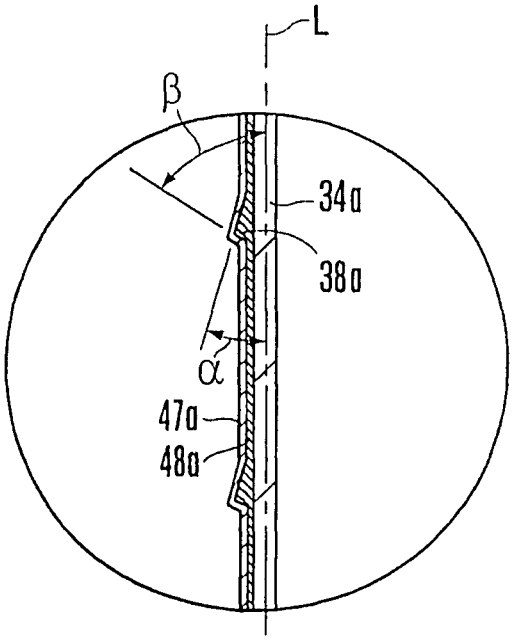
FIG. 3*b* is a detail view of another type of surface irregularity.

FIG. 3*a* shows that the surface irregularity 38 can be formed in the shaft 34. The shaft 34 acts as a substrate to which a reflective film 47 is attached using an adhesive 48. As described in detail below, the adhesive 48 is disposed on the substrate and then the film 47 is laid over the adhesive 48. FIG. 3*b* shows that a surface irregularity 38*a* can be formed in an adhesive 48*a* instead of a substrate, i.e., a shaft 34*a*. Then, as described in detail below, a film 47*a* can be laid over the adhesive 48*a*. In either case, whether formed in the substrate or the adhesive 48, 48*a*, since the film 47, 47*a* conforms to the adhesive 48, 48*a* and the substrate, the irregularity introduces a surface anomaly in an otherwise smooth cylindrical film surface for diffusing light.

Figure 3C:
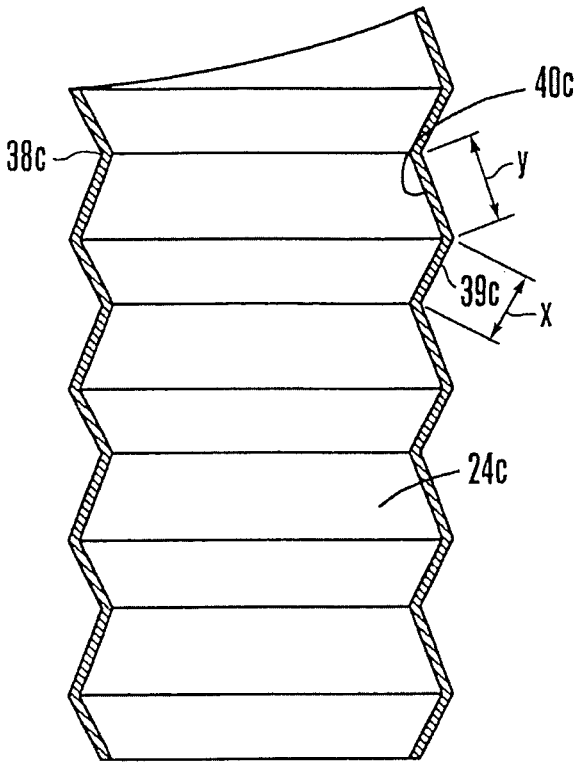
FIG. 3*c* is a detail view of yet another type of surface irregularity.

Still further, as shown in FIG. 3*c* plural radial grooves 38*c* can completely or partially circumscribe a shaft 24*c* to establish the present surface irregularity. Each groove 38*c* can have an upper segment 39*c* and a lower segment 39*d*, with the length "x" of each upper segment 39*c* being one-half the length "y" of the lower segment 40*c*.

Figure 3D:
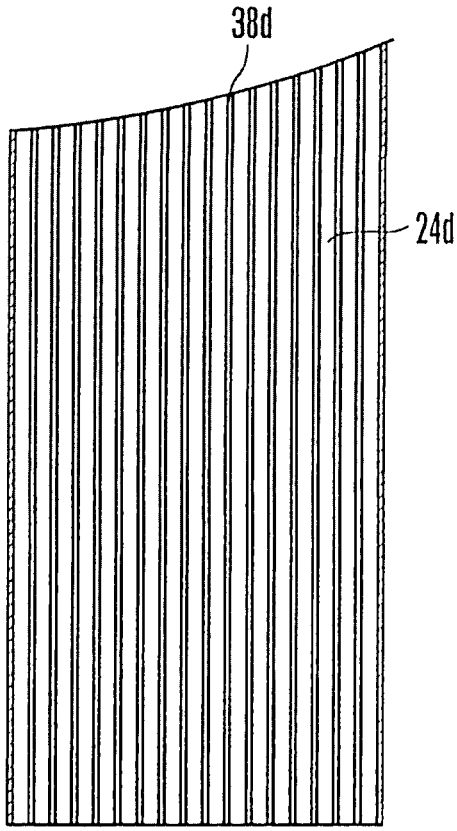
FIG. 3*d* is a detail view of still another type of surface irregularity.

As yet another example, FIG. 3*d* shows that plural longitudinal grooves 38*d* that run part way or completely the vertical length of a skylight shaft 24*d* can establish the present surface irregularities. Or, surface irregularities can be formed randomly, without any pattern at all.

Figure 4:
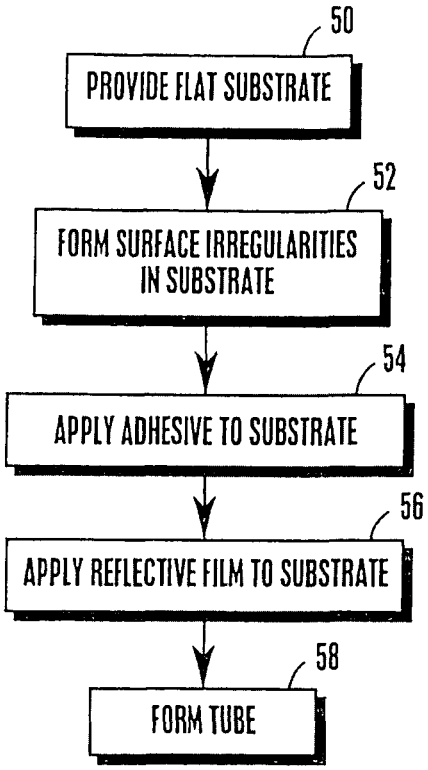
FIG. 4 is flow chart of a method for forming the surface irregularities.

Referring now to FIG. 4, a method for forming the surface irregularities 38 is shown. Commencing at block 50, a flat substrate, e.g., a sheet of aluminum or steel, is provided. At block 52, the surface irregularities 38 are formed in the substrate. The surface irregularities can, e.g., be formed by moving the substrate through appropriately formed rollers, rolling an appropriately formed roller across the substrate, or pressing the substrate with an appropriately formed press. Returning to the logic, at block 54 adhesive is applied to the substrate. Thereafter, a reflective film is applied to the substrate on the adhesive. At block 58, a shaft, having the surface irregularities on the inside, can be formed by bending the flat substrate into a cylinder.

Figure 5:
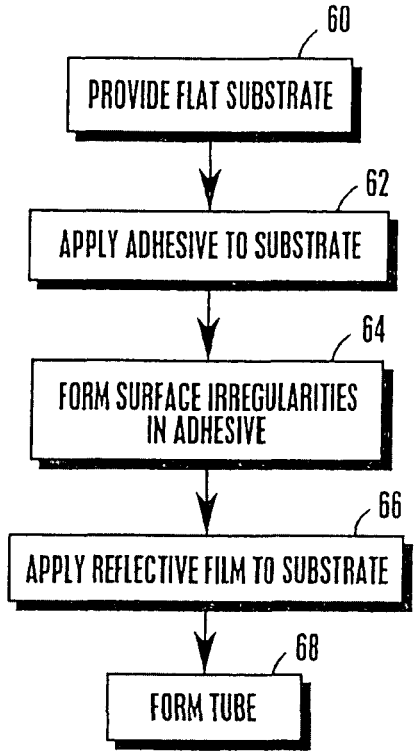
FIG. 5 is a flow chart of a first alternative embodiment of the method for forming the surface irregularities.

FIG. 5 shows a first alternative method for forming the surface irregularities of the present invention. Commencing at block 60, a flat substrate is provided. At block 62, adhesive is applied to the substrate. Moving to block 64, the surface irregularities are formed in the adhesive by, e.g., rolling the adhesive using a roller having a pattern in the desired configuration, so that portions of the adhesive are thicker than other portions, establishing the irregularities. Thereafter, at block 66, a reflective film is applied to the substrate over the adhesive formed with the surface irregularities. Continuing to block 68, a shaft is formed from the substrate.

Figure 6:
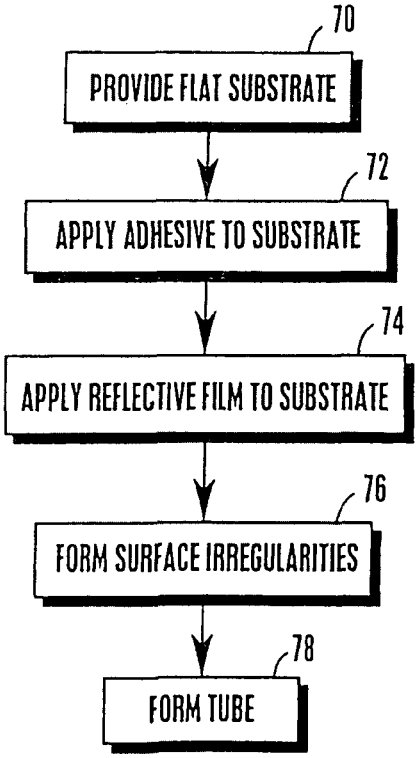
FIG. 6 is a flow chart of a second alternative embodiment of the method for forming the surface irregularities by deforming the adhesive layer.

Referring to FIG. 6 a second alternative method for forming the surface irregularities is shown and commences at block 70 wherein a flat substrate is provided. Then, at block 72 an adhesive is applied to the substrate. Proceeding to block 74, a reflective film is applied to the substrate on the adhesive. At block 76, the surface irregularities are formed by, e.g., rolling a roller across the film, to alter the thickness of the adhesive between the film and the substrate in the appropriate places. Thereafter, at block 78, a shaft can be formed with the surface irregularities located in the interior of the shaft.

Figure 7:
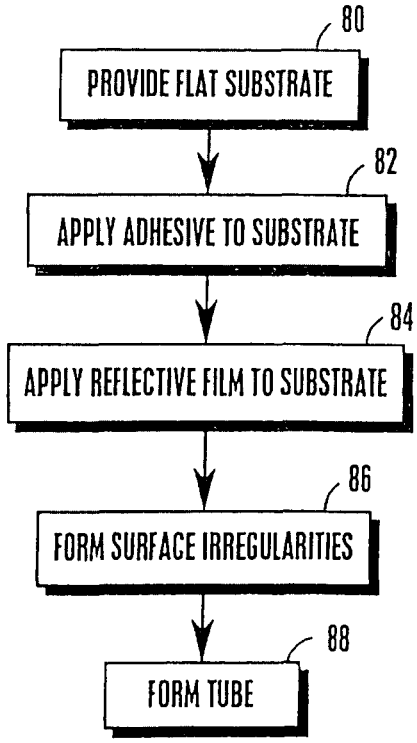
FIG. 7 is a flow chart of a third alternative embodiment of the method for forming the surface irregularities by deforming the substrate and reflective film system.

FIG. 7 shows a third alternative embodiment for forming the present surface irregularities. Commencing at block 80, a flat substrate is provided. Continuing to block 82 an adhesive is applied to the substrate. Then, at block 84 a reflective film is applied to the substrate over the adhesive. Moving to block 86, the surface irregularities are formed in the substrate such that they protrude through the reflective film. The surface irregularities can be formed, e.g., by moving the substrate with the film glued, or otherwise attached thereto, through appropriately formed rollers. Thereafter, a shaft can be formed that has the surface irregularities formed therein.

It is to be understood that each tubular component of the shaft assembly 24 can be formed with the surface irregularities 38 described above. Moreover, it can be appreciated that the surface irregularities 38 effectively diffuse sunlight entering the shaft assembly 24 such that focal points are reduced at the diffuser. Moreover, hot spots within the light exiting the shaft assembly 24 are eliminated.

Figure 8:
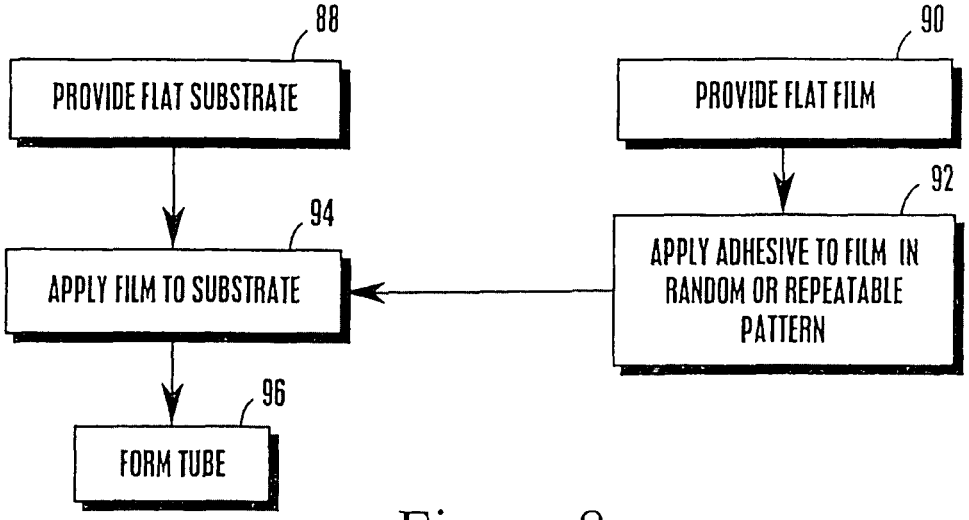
FIG. 8 is a flow chart of another alternative embodiment of the method for forming the surface irregularities.

FIG. 8 shows another way of forming the surface irregularities. Commencing at block 88 the substrate is provided, and at block 90 the film is provided. At block 92 the adhesive is applied to the film to establish the desired surface irregularities. The film is then applied to the substrate at block 94, and the substrate then formed into the shaft, tubular or otherwise, at block 96.

Figure 9:
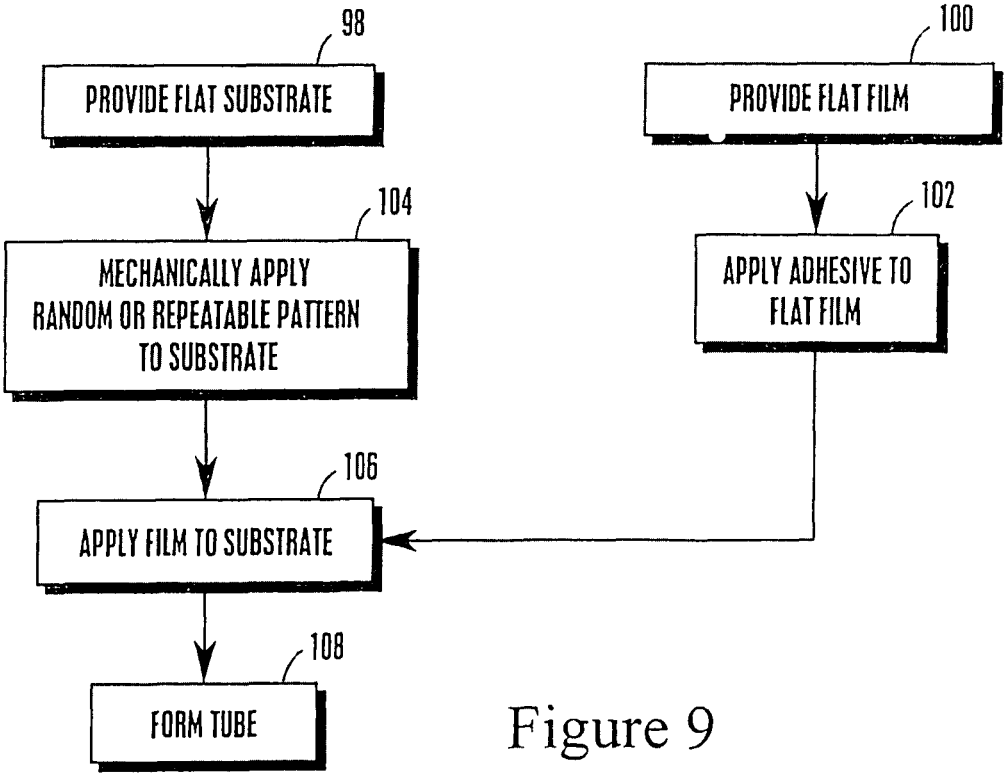
FIG. 9 is a flow chart of another alternative embodiment of the method for forming the surface irregularities.

FIG. 9 shows yet another way of forming the surface irregularities. Commencing at block 98 the substrate is provided, and at block 100 the film is provided. The adhesive is applied to the film at block 102 in a thin, uniform layer. In contrast, at block 104 a random or repeatable surface irregularity pattern is applied to or formed in the substrate, either before or after applying the adhesive to the film at block 102. The film, is then adhered to the substrate at block 106, and the substrate then formed into the shaft, tubular or otherwise, at block 108.

While the particular SKYLIGHT TUBE WITH REFLECTIVE MATERIAL SURFACE AND SURFACE IRREGULARITIES as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". All structural and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims.

What is claimed is:

1. A skylight assembly, comprising:

at least one non-transparent skylight shaft defining at least one segment, the segment having an axially straight outer surface throughout bounded by opposed ends, the shaft being entirely non-transparent so that no light can enter the shaft through the outer surface;

at least one surface irregularity formed in the shaft; and a skylight cover covering a top end of the shaft.

2. The skylight assembly of claim 1, further comprising:

a diffuser plate covering a bottom end of the shaft.

3. The skylight assembly of claim 1, wherein plural surface irregularities are formed without defining a pattern.

4. The skylight assembly of claim 1, wherein the surface irregularities establish a pattern.

5. The skylight assembly of claim 1, wherein each surface irregularity includes:

an upper face establishing a first angle with respect to a long axis of the shaft; and a lower face establishing a second angle with respect to the long axis of the shaft, the first angle being more acute than the second angle.

6. A skylight assembly, comprising:

a shaft defining at least one segment, the segment having an axially straight outer surface throughout bounded by opposed ends and permitting light entry into the segment only through the opposed ends;

a cover covering a tap end of the shad and permitting light to propagate through the cover into the shaft; and a reflective surface on the inside of the shaft, the reflective surface on the inside of the shaft defining at least one diffusion anomaly on an otherwise smooth inner shad surface.

7. The skylight assembly of claim 6, wherein the reflective surface on the inside of the shaft is established by a film adhered to the shaft.

8. The skylight assembly of claim 6 wherein the reflective surface on the inside of the shaft is established by the shaft.

* * * * *

UNITED STATES PATENT AND TRADEMARK OFFICE

CERTIFICATE OF CORRECTION

PATENT NO. : 8,955,269 B2
APPLICATION NO. : 12/349084
DATED : February 17, 2015
INVENTOR(S) : Rillie It is certified that error appears in the above-identified patent and that said Letters Patent is hereby corrected as shown below:

In the Claims,

Column 7, line 11, “tap” should read - top -.
Column 7, line 11, “shad” should read - shaft -.
Column 7, line 15, “shad” should read - shaft -.

Signed and Sealed this
Twelfth Day of May, 2015

Michelle K. Lee

Michelle K. Lee
*Director of the United States Patent and Trademark Office*